United States Patent [19]

Henriksson et al.

[11] Patent Number: 5,011,376

[45] Date of Patent: Apr. 30, 1991

[54] VALVE CONTROL SYSTEM FOR AN AIR DISPLACEMENT TYPE PUMP

[76] Inventors: Kurt K. G. Henriksson, 328 - 8500 Ackroyd Rd., Richmond, British Columbia, Canada, V6K 3H8; Raymond A. Breckner, 4695 Britania Dr., Richmond, British Columbia, Canada, V6G 1K9

[21] Appl. No.: 504,838

[22] Filed: Apr. 5, 1990

[51] Int. Cl.[5] ..... F04F 1/02

[52] U.S. Cl. ..... 417/145; 417/141; 417/507; 417/120

[58] Field of Search ..... 417/120, 141, 145, 137, 417/139, 507, 142, 132

[56] References Cited

U.S. PATENT DOCUMENTS

| | | | |
|---|---|---|---|
| 1,724,855 | 8/1929 | Small | 417/139 |
| 2,383,193 | 8/1945 | Herbert . | |
| 2,526,801 | 10/1950 | Brown | 417/141 |
| 2,764,104 | 9/1956 | Yeomans | 417/120 |
| 2,821,930 | 2/1958 | Smith | 417/507 |
| 2,943,578 | 7/1960 | McCombie . | |
| 3,266,574 | 8/1966 | Gandy | 417/137 |
| 3,969,041 | 7/1976 | Thausing et al. | 417/507 |
| 4,770,610 | 9/1988 | Breckner | 417/140 |

*Primary Examiner*—Leonard E. Smith
*Assistant Examiner*—M. Kocharov
*Attorney, Agent, or Firm*—C. A. Rowley

[57] ABSTRACT

A valve control system for an air displacement type pump operates the inlet or outlet valve in accordance with the pressure differential between the inlet line and the main pump chamber or the outlet line and the main pump chamber respectively such that the inlet valve is open when the pressure in the pump chamber is less than the pressure in the inlet line and the outlet valve is opened when the pressure in the chamber is greater than the pressure in the outlet line.

8 Claims, 1 Drawing Sheet

VALVE CONTROL SYSTEM FOR AN AIR DISPLACEMENT TYPE PUMP

FIELD OF THE INVENTION

The present invention relates to a valve control system. More particularly the present invention relates to a valve control system for an air displacement type pump particularly suited for pumping frail material such as fish.

BACKGROUND OF THE PRESENT INVENTION

Generally air displacement type pumps include both an inlet valve and an outlet valve that are suitable controlled by some form of timer system, see for example U.S. Pat. No. 2,383,193 issued Aug. 21, 1945 to Hiebert or by means of weight sensors or other types of controls to actuate the valve at the appropriate time as required by the pumping process.

In systems where self-actuating valves are used, i.e. flap valves that are moved from open to closed position depending on the pressure differential across the valve, the valve is open or closed depending on the control to the pump, i.e. the application of positive or negative pressure to the main pump chamber which is controlled for example as described in U.S. Pat. No. 2,943,578 issued Jul. 5, 1960 to McCombie.

Air displacement type pumps have found to be particularly suitable in pumping frail materials such as fish slurries, etc. and preventing damage to the fish. A recently issued U.S. Pat. No. 4,770,610 issued Sept. 13, 1988 to Breckner, teaches the use of bladder type valves on inlet and outlet lines to an air dispacement pump used for pumping fish. In this system, the bladder valves are opened and closed by applying pressure to the outside chamber of the bladder valve to close the valve at the appropriate time. The timing of this opening or closing of the valve is preferably obtained by means of computer operated solenoid valves controller to operate in the desired sequence for opening and closing of the inlet and valves and applying positive and negative pressure to the main pump chamber.

BRIEF DESCRIPTION OF THE PRESENT INVENTION

It is an object of the present invention to provide a simplified control system for an air displacement type pump.

Broadly the present invention relates to a control system for an air displacement type pump, said pump comprising a tank, inlet line to said tank and an outlet line from said tank, an inlet valve in said inlet line and an outlet valve in said outlet line means for selectively applying positive or negative air pressure to said tank, means to actuate said outlet valve including means to compare pressure in said tank with pressure in said line on the side of said outlet valve remote from said tank, said means to compare controlling said means to actuate said outlet valve to maintain said outlet valve closed when said pressure in said outlet line exceeds the pressure in said tank and to open said outlet valve when the pressure in said tank exceeds the pressure in said outlet line.

Preferably the system will include a second means to actuate said inlet valve including second means to compare the pressure in said tank with the pressure in said inlet line on the side of said inlet valve remote from said tank, said second means to compare controlling said second means to actuate said inlet valve to maintain said inlet valve closed when said pressure in said inlet line is lower than the pressure in said tank and to open said inlet valve when the pressure in said tank is lower than the pressure in said inlet line.

Preferably said inlet and outlet valves will be bladder valves and said means to actuate includes means to apply fluid pressure to said valves and close said valves at the apropriate times.

Preferably said means to compare and said second means to compare will each comprise a diaphragm with the pressure on one side of said diaphragm representing said pressure in said outlet or inlet line respectively and the pressure on the opposite side of diaphragm representing the pressure in said tank and wherein said diaphragm is connected to a valve means adapted to direct fluid under pressure to said outlet or said inlet valve respectively to operate said outlet or inlet valves repectively.

Preferably said system will further comprise a tank level control sensing when the tank is empty and a flow control switch sensing flow in said inlet line, said flow control switch actuating a normally closed switch, said tank level control actuating a normally open second switch, said normally closed and said normally open switches being arranged in series and adapted to control the application of positive air pressure to said tank when said normally closed switch and said normally open switch are both closed, said normally closed switch remaining closed when there is no flow sensed by said flow switch and said normally open switch being open when said tank level control indicates said tank is empty and a control valve means for selectively connecting said tank to a source of negative air pressure when said tank is disconnected from said source of positive air pressure.

BRIEF DESCRIPTION OF THE DRAWINGS

Further features, objects and advantages will be evident from the following detailed of the preferred embodiments of the present invention taken in conjunction with the accompanyings drawings in which:

FIG. is a schematic illustration of a pump incorporating a control system incorporating the present invention.

DESCRIPTION OF THE PREFERRED EMBODIMENTS

Figure 1:
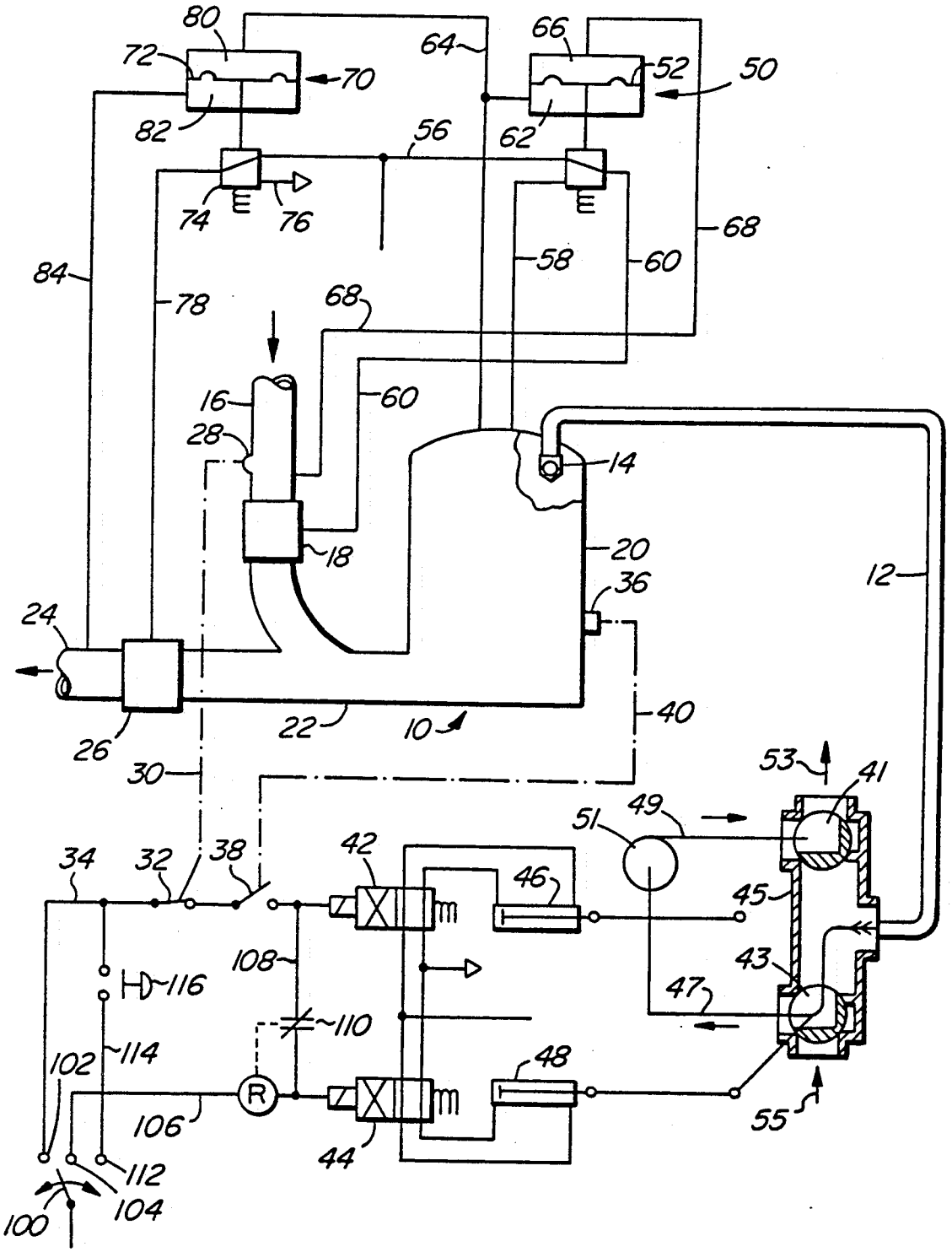

The air displacement pump of the present invention includes a tank 10 which is connected via a pipe or conduit 12 selectively to a source of positive and negative air pressure as will be described in more detail hereinbelow. The pipe 12 is connected to the tank 10 spaced slightly below the top of tank 10 and is provided with a float valve 14 that closes the conduit 12 when the tank 10 is almost full.

The pump includes an inlet line 16 having an inlet valve 18 which preferably is a bladder type valve as described for example in U.S. Pat. No. 4,770,610 issued Sept. 13, 1988 to Breckner is connected to the tank 10 adjacent the bottom 20 thereof by a connector pipe 22.

An outlet line 24 provided with a bladder valve 26 substantially the same as the bladder valve 18 in the inlet line 16 is also connected to the tank 10 by the connector pipe 22.

The inlet line 16 is provided with a flow switch 28 that switches when there is flow and when there is a no-flow condition and, as indicated by the dot-dash line 30, controls a normally closed switch 32 in the auto control circuit line 34. The switch 32 is in closed position as illustrated when there is a no-flow condition, i.e. no flow through the inlet line 16 and is moved to open position by switching of the switch 28 when there is flow in line 16.

A tank level control 36 operates a normally open switch 38 (as indicated by the dot-dash control line 40) in the auto control circuit line 34. The normally open switch 38 is open when the tank level control 36 senses that the tank is empty.

The application of positive pressure air or negative air pressure to the tank 10 via line 12 is controlled by a pair of control valves 42 and 44 which operate piston and cylinders 46 and 48 respectively. The piston and cylinders 46 and 48 rotate the ball valves 41 and 43 respectively of the control valve 45 to selectively connect the line 12 leading to tank 10 to the inlet 47 (negative air pressure source) or the outlet 49 (positive air pressure source) of the compressor 51.

At start up the tank 10 is empty and there is no flow in line 16, thus the switches 32 and 38 are in the position indicated so with the switch 100 applying power to the contact 102 and thus to the auto control circuit line 34 the circuit to the valves 42 and 44 is interrupted and thus the line 12 disconnected from the high pressure source 49 and is connected with the source of negative air pressure 47 so that the air is withdrawn from the tank 10, as will be described in further detail hereinbelow. In this position the ball valves 41 and 43 of the main control valve 45 are in the positions illustrated and air is drawn from tank 10 through line 12, ball valve 43, line 47 into the compressor 51 and blown from the compressor 51 through line 49 and ball valve 41 to an exhaust system (muffler) as illustrated by the arrow 53.

The operation of the inlet and outlet valves 18 and 26 are controlled by a pair of similar differential pressure operated two position three way valves. The inlet controller 50 includes an inlet diaphragm 52 that is connected to and operates an inlet two position three way valve 54 having a first position connecting with line 56 from a source of high pressure air (40 psi) and a second position connected to line 58 connected to the top of the tank 10. The line 58 connects to the line 60 at the appropriate time as will be described below and applies the then current pressure in the tank 10 which will at this time be a negative air pressure to the valve 18 to tend to hold the valve open and better overcome the suction in the line 16 tending to draw the bladder of valve 18 to closed position.

The valve 54 is connected via line 60 to the inlet bladder valve 18 and connects the bladder valve 18 either to the high pressure source 56 to close the bladder valve or to line 58 to apply negative pressure to open or hold open the bladder valve 18.

The chamber 62 on one side of the inlet diaphragm 52 is connected via line 64 to sense the pressure within the tank 10 while the chamber 66 on the opposite side of the diaphragm 52 is connected via line 68 to sense be pressure in the inlet line 16 upstream of the valve 18. If the pressure in the inlet line 16 is lower than the pressure in the tank 10, i.e. pressure in chamber 66 is lower than the pressure in chamber 62, the diaphragm 52 will be deflected upwardly and the valve 54 will be in the position illustrated connecting the pressure source 56 via line 60 to the bladder valve 18 to close the bladder valve. On the other hand, if the pressure in the tank 10 is lower than the pressure in the inlet line 16, the inlet diaphragm 52 will be deflected downwardly and the valve 54 will connect the line 60 to the line 58 and thus to the negative air pressure in the tank 10 and apply this negative pressure to the bladder valve 18 and open same.

The outlet valve 26 has a similar controller 70 that incorporates an outlet diaphragm 72 connected to and operating an outlet operating valve 74 having a first position connecting with the high pressure source 56 and a second position connecting with a vent 76. The positive pressure in the line 24 when the valve 26 is open and the tank 10 is being emptied tend to hold the valve 26 open at the appropriate time and thus no suction is applied to the outside of the bladder of outlet valve 26 to hold the valve 26 open as was provided for inlet valve 18. The valve 74 is connected via line 78 to the bladder valve 26 to connect the bladder valve 26 to either the source of high pressure air 56 or to vent 76 thereby to close and open the bladder valve 26 respectively.

The (top) chamber 80 on one side of the diaphragm 72 is connected to line 64 and thus corresponds to the pressure in the tank 10 while the (bottom) chamber 82 is connected via line 84 to the outline line 24 on the side of the valve 26 remote from the tank 10 and is adapted to register the pressure in the outlet line 24.

It will be apparent that if the pressure in line 84, i.e. outlet line 24 is higher than the pressure in the line 64, i.e. in the tank 10, then the diaphragm 72 is deflected upwardly and the valve 74 will be in the position as illustrated connecting the high pressure source 56 with the bladder valve 26 to close the bladder valve 26. Alternatively, if the pressure in the tank 10 is higher than the pressure in the line 24, the valve 74 will be moved to its second position connecting the line 78 to the vent 76 and permitting the bladder valve 26 to open.

It will be apparent that the system described above is relatively simple and inexpensive yet will properly and accurately activate the inlet and outlet valve 18 and 26 respectively at the appropriate times dependent solely on pressure differentials. Similarly the flow control switch 28 and tank level control 34 when the unit is in auto operation will control the application of high pressure air or negative pressure air as the case may be to the chamber or tank 10.

For example, upon start-up with the control switch 100 connected to contact 102 so that the automatic circuit 34 is activated the tank 10 is connected to the negative air pressure source 47 since is no current flowing i.e. the switch 38 is open so no current flow to the solenoid valves 42 and 44 and the ball valves 41 and 43 are in the positions illustrated. (Obviously to commence operation the compressor 51 has to be activated.) Thus the pressure in the tank 10 reduces which reduces the pressure in chamber 62 of the inlet valve controller 50 thereby moving the valve 54 to connect the line 60 with 58 and apply a negative pressure to the outside of the bladder of bladder valve 18 to open the bladder valve 18. The pressure in chamber 80 of the outlet valve controller 70 is reduced so that the valve 74 remains in the position illustrated with the pressure line 56 connected to the line 78 and holds the outlet valve 26 closed.

As the tank fills, obviously flow occurs through the conduit 16 which activates the flow switch 28 and moves the switch 32 to open position. However the tank 10 is filling and the switch 38 is moved to closed position by the tank level control 36 sensing that the tank is filling. The circuit 34 to the valves 42 and 44 remains interrupted by the switch 32 which is now open.

When the level material (say a fish water slurry) in the tank 10 approaches the inlet of line 12 into the tank 10 the ball 14 closes off the conduit 12 thus the tank is disconnecting the tank 10 from the source of negativre air pressure (vacuum) and flow of material into the tank 10 begins to slow and then stops which shifts switch 32 to closed position to activate valves 42 and 44 and apply pressure to the tank 10 as will be described below and the pressure in the tank 10 is now higher than the pressure in the line 16 triggering the movement of the diaphragm 52 to cause the valve 54 to connect the valve 18 to the high pressure source 56 and close the valve 18. When the flow stops the flow switch 28 no longer senses flow in the line 16 and reverts to its normally closed cylinders 46 and 48 respectively to change the positions, i.e. rotate through 90°, the ball valves 41 and 43 respectively of the control valve 45 and disconnect the negative pressure source 47 from the line 12. This rotation of the valves 41 and 43 connects the inlet 47 to the blower 51 to intake 55 via valve 43 and outlet 49 (the positive air pressure source 49) is disconnected from the muffler 53 and connected with the line 12 to apply positive air pressure to the tank 10 thereby increasing the pressure in tank 10. The pressure in the tank 10 soon exceeds the pressure in the outlet line 24 causing the diaphragm 72 to shift position and connect line 78 to atmosphere and permit the valve 26 to open thereby the material in the tank 10 is then exhausted through the pipe 22, valve 26 and outlet 24.

When the level of material (fish slurry) in the tank 10 is reduced to the appropriate level, the tank level control 36 senses the tank is empty and opens the switch 38 thereby deactivating the valves 42 and 44 and returning them to their initial positions and rotating each of the ball valves 41 and 43 through 90° back to their illustrated positions thereby reconnecting the negative air pressure source 47 with line 12 and the positive source 49 with the muffler 53 to repeat the cycle, i.e. this will cause the pressure in the tank 10 to be reduced significantly and thereby shift the valve 26 to the close condition and the valve 18 to the open position.

Thus under automatic operation system will continue to operate in this manner until turned off.

In what is designated the neutral position the switch 100 is connected to contact 104 on circuit line 106 which activates the relay R which via controlled switch 110 disconnects the bridge 108 between the valves 42 and 44 so that only valve 44 is activated and not valve 42. The activated relay 44 activates the piston and cylinder 48 to rotate the ball valve 43 through 90° and connect the negative air pressure source to inlet line 53 insteadd of line 12 i.e. disconnect the source of vacuum 47 from the tank 10.

When only a partial operation is desired, the power is supplied from switch 100 via contact 112 to the circuit line 114 (partial circuit) having a switch 116 which when held in closed position supplies power to automatic circuit line 34. This partial circuit is used to control emptying of the tank when the full contents of the pump tank 10 are not to be displaced. When, for example, the tank 10 has been partially emptied i.e. switch 38 is closed and there is no flow in line 16 i.e. the tank 10 is in the discharge mode opening of the switch 116 disconnects the solenoid valves 42 and 44 and terminating the application of pressure to the tank 10 to stop pumping from the tank and transforms the system into an intake operation applying negative air pressure to the tank 10 and drawing more material into the tank until the tank fills.

Having described the invention, modifications will be evident to those skilled in the art without departing from the spirit of the invention as defined in the appended claims.

We claim:

1. A control system for an air displacement type pump, said pump comprising a tank, inlet line to said tank and an outlet line from said tank, an inlet valve in said inlet line and an outlet valve in said outlet line means for selectively applying positive or negative air pressure to said tank, means to actuate said outlet valve including means to compare pressure in said tank with pressure in said outlet line on the side of said outlet valve remote from said tank, said means to compare controlling said means to actuate said outlet valve to maintain said outlet valve closed when said pressure in said outlet exceeds the pressure in said tank and to open said outlet valve when the pressure in said tank exceeds the pressure in said outlet line.

2. A system as defined in claim 1 further including a second means to actuate said inlet valve including second means to compare the pressure in said tank with the pressure in said inlet line on the side of said inlet valve remote from said tank, said second means to compare controlling said second means to actuate said inlet valve to maintain said inlet valve closed when said pressure in said inlet line is lower than the pressure in said tank and to open said inlet valve when the pressure in said tank is lower than the pressure in said inlet line.

3. A system as defined in claim 2 wherein said inlet and outlet valves are bladder valves and means to actuate includes means to applying fluid pressure to said valves and close said valves at the appropriate times.

4. A system as defined in claim 3 wherein said means to compare and said second means to compare each comprises a diaphragm with the pressure on one side of said diaphargm representing said pressure in said outlet or inlet line respectively and the pressure on the opposite side of said diaphragm representing the pressure in said tank and wherein said diaphragm is connected to a valve means adapted to direct fluid under pressure to said outlet or said inlet valve respectively to operate said outlet or inlet valves respectively.

5. A system as defined in claim 1 further comprising a tank level control sensing when said tank is empty and a flow control switch sensing flow in said inlet line, said flow control switch actuating a normally closed switch, said tank level control actuating a normally open second switch, said normally closed and said normally open switches being arranged in series and adapted to control means to apply positive air pressure or negative air pressure to said tank to apply positive air pressure to said tank when said normally closed switch and said normally open switch are both closed, said normally closed switch remaining closed when there is no flow sensed by said flow switch and said normally open switch being closed when said tank level control indicates said tank is not empty and to apply a negative air pressure to said tank when either or both of said normally open and said normally closed switches is open.

6. A system as defined in claim 2 further comprising a tank level control sensing when said tank is empty and a flow control switch sensing flow in said inlet line, said flow control switch actuating a normally closed switch, said tank level control actuating a normally open second switch, said normally closed and said normally open switches being arranged in series and adapted to control means to apply positive air pressure or negative air pressure to said tank to apply positive air pressure to said tank when said normally closed switch and said normally open switch are both closed, said normally closed switch remaining closed when there is no flow sensed by said flow switch and said normally open switch being closed when said tank level control indicates said tank is not empty and to apply a negative air pressure to said tank when either or both of said normally open and said normally closed switches is open.

7. A system as defined in claim 3 further comprising a tank level control sensing when said tank is empty and a flow control switch sensing flow in said inlet line, said flow control switch actuating a normally closed switch, said tank level control actuating a normally open second switch, said normally closed and said normally open switches being arranged in series and adapted to control means to apply positive air pressure or negative air pressure to said tank to apply positive air pressure to said tank when said normally closed switch and said normally open switch are both closed, said normally closed switch remaining closed when there is no flow sensed by said flow switch and said normally open switch being closed when said tank level control indicates said tank is not empty and to apply a negative air pressure to said tank when either or both of said normally open and said normally closed switches is open.

8. A system as defined in claim 4 further comprising a tank level control sensing when said tank is empty and a flow control switch sensing flow in said inlet line, said flow control switch actuating a normally closed switch, said tank level control actuating a normally open second switch, said normally closed and said normally open switches being arranged in series and adapted to control means to apply positive air pressure or negative air pressure to said tank to apply positive air pressure to said tank when said normally closed switch and said normally open switch are both closwd, said normally closed switch remaining closed when there is no flow sensed by said flow switch and said normally open switch being closed when said tank level control indicates said tank is not empty and to apply a negative air pressure to said tank when either or both of said normally open and said normally closed switches is open.

* * * * *